US009540940B2

(12) United States Patent
Liotta et al.

(10) Patent No.: US 9,540,940 B2
(45) Date of Patent: Jan. 10, 2017

(54) TURBINE INTERSTAGE SEAL SYSTEM

(75) Inventors: Gary Charles Liotta, Simpsonville, SC (US); Brian Denver Potter, Greer, SC (US)

(73) Assignee: General Electric Company, Schenectady, NY (US)

( * ) Notice: Subject to any disclaimer, the term of this patent is extended or adjusted under 35 U.S.C. 154(b) by 1308 days.

(21) Appl. No.: 13/418,281

(22) Filed: Mar. 12, 2012

(65) Prior Publication Data

US 2013/0236289 A1 Sep. 12, 2013

(51) Int. Cl.
*F01D 11/00* (2006.01)

(52) U.S. Cl.
CPC ..... *F01D 11/001* (2013.01)

(58) Field of Classification Search
CPC ..... F01D 11/001; F01D 11/02; F01D 5/06; F01D 5/066; F02C 7/28
USPC ..... 415/170.1, 173.7, 174; 416/174
See application file for complete search history.

(56) References Cited

U.S. PATENT DOCUMENTS 2,656,147 A * 10/1953 Brownhill ..... F01D 5/084 416/193 A
3,094,309 A * 6/1963 Hull, Jr. ..... F01D 5/06 415/173.7
3,295,825 A * 1/1967 Hall, Jr. ..... F01D 5/06 415/173.7
3,533,711 A * 10/1970 Kercher ..... F01D 5/187 415/116
3,733,146 A * 5/1973 Smith ..... F01D 11/001 415/173.7
4,094,673 A * 6/1978 Erickson ..... B22F 3/002 415/174.4
4,127,359 A * 11/1978 Stephan ..... F01D 11/005 416/198 A
4,309,147 A * 1/1982 Koster ..... F01D 5/08 415/121.2

(Continued)

FOREIGN PATENT DOCUMENTS

CH 703590 A2 2/2012
CN 101818661 A 9/2010

(Continued)

OTHER PUBLICATIONS

Unofficial English Translation of Chinese Office Action issued in connection with corresponding CN Application No. 201310078297.9 on Aug. 5, 2015.

*Primary Examiner* — Sean J Younger
(74) *Attorney, Agent, or Firm* — Fletcher Yoder, P.C.

(57) ABSTRACT

A system includes a multi-stage turbine. The multi-stage turbine has an interstage seal extending axially between a first turbine stage and a second turbine stage. The interstage seal has an upper body that extends from an upstream seating arm to a downstream seating arm. The upstream and downstream seating arms are designed to constrain movement of the interstage seal along a radial direction of the multi-stage turbine. The interstage seal also has a lower body that extends from a seating end to a hook end. The seating end is designed to constrain movement of the interstage seal along the radial direction. The hook end has a protrusion that extends crosswise relative to a base of the lower body. The hook end is designed to constrain movement of the interstage seal along the radial direction and an axial direction of the multi-stage turbine.

6 Claims, 10 Drawing Sheets

(56) References Cited

U.S. PATENT DOCUMENTS 4,332,133 A * 6/1982 Schwarz ..... F01D 11/001 415/115
4,470,757 A * 9/1984 Vollinger ..... F01D 5/3015 416/193 A
4,645,424 A * 2/1987 Peters ..... F01D 5/026 415/173.7
4,655,683 A * 4/1987 Chaplin ..... F01D 11/18 415/137
4,659,289 A * 4/1987 Kalogeros ..... F01D 5/3015 415/173.7
4,669,959 A * 6/1987 Kalogeros ..... F01D 5/3015 415/199.5
4,869,640 A * 9/1989 Schwarz ..... F01D 11/001 415/115
4,884,950 A * 12/1989 Brodell ..... F01D 5/081 415/173.7
5,054,996 A * 10/1991 Carreno ..... F01D 11/18 415/115
5,157,914 A * 10/1992 Schwarz ..... F01D 5/081 415/115
5,236,302 A * 8/1993 Weisgerber ..... F01D 5/06 415/173.7
5,338,154 A * 8/1994 Meade ..... F01D 11/001 403/371
5,339,619 A * 8/1994 Antonellis ..... F01D 11/006 416/220 R
5,358,374 A * 10/1994 Correia ..... F01D 5/081 415/115
5,758,487 A * 6/1998 Salt ..... F01D 5/084 415/114
5,833,244 A * 11/1998 Salt ..... F01D 11/001 277/418
6,899,520 B2 5/2005 Habedank et al.
7,052,240 B2 * 5/2006 Race ..... F01D 5/3015 416/198 A
7,220,099 B2 * 5/2007 Bekrenev ..... F01D 11/005 415/173.7
8,177,495 B2 5/2012 Bowes et al.
8,235,656 B2 8/2012 Wilson et al.
8,348,603 B2 1/2013 Garcia-Crespo et al.
8,511,976 B2 8/2013 Cummins et al.
2003/0082049 A1 5/2003 Brisson et al.
2005/0129525 A1 * 6/2005 Bekrenev ..... F01D 11/005 416/248
2010/0074731 A1 * 3/2010 Wiebe ..... F01D 11/005 415/173.4
2010/0074732 A1 * 3/2010 Marra ..... F01D 5/025 415/173.4
2010/0178160 A1 7/2010 Liotta et al.
2010/0209233 A1 * 8/2010 Wilson ..... F01D 11/001 415/173.7
2012/0027584 A1 * 2/2012 Cummins ..... F01D 11/003 415/230

FOREIGN PATENT DOCUMENTS

CN 101852100 A 10/2010
CN 101858257 A 10/2010

* cited by examiner

TURBINE INTERSTAGE SEAL SYSTEM

BACKGROUND OF THE INVENTION

The subject matter disclosed herein relates to gas turbines, and more specifically, to interstage seals within gas turbines.

In general, gas turbine engines combust a mixture of compressed air and fuel to produce hot combustion gases. The combustion gases may flow through one or more turbine stages to generate power for a load and/or compressor. A pressure drop may occur between stages, which may allow leakage flow of a fluid, such as combustion gases, through unintended paths. Seals may be disposed between the stages to reduce fluid leakage between the stages. Unfortunately, the shape of the seal may increase the spacing required between stages of the turbine. In addition, the shape of the seal may make access to internal components of the turbine more difficult. Furthermore, the seal may require additional components, such as spacers, to ensure proper axial and radial alignment of the seal.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In accordance with a first embodiment, a system includes a multi-stage turbine. The multi-stage turbine has an interstage seal extending axially between a first turbine stage and a second turbine stage. The interstage seal has an upper body that extends from an upstream seating arm to a downstream seating arm. The upstream and downstream seating arms are designed to constrain movement of the interstage seal along a radial direction of the multi-stage turbine. The interstage seal also has a lower body that extends from a seating end to a hook end. The seating end is designed to constrain movement of the interstage seal along the radial direction. The hook end has a protrusion that extends crosswise relative to a base of the lower body. The hook end is designed to constrain movement of the interstage seal along the radial direction and an axial direction of the multi-stage turbine.

In accordance with a second embodiment, a system includes an interstage turbine seal. The interstage turbine seal has a cross-sectional profile. The cross-sectional profile includes an upper body that has a substantially linear sealing portion. The substantially linear sealing portion extends from an upstream seating arm to a downstream seating arm. The cross-sectional profile also includes a lower body that has an upstream seating end and a downstream hook end. The downstream hook end has a protrusion that extends towards the downstream seating end of the upper body. Additionally, the sealing portion of the upper body includes multiple sealing teeth disposed on a side of the sealing portion opposite the lower body.

In accordance with a third embodiment, a method includes radially constraining an interstage seal of a multi-stage turbine using an upstream seating arm of an upper body of the interstage seal, a downstream seating arm of the upper body, a seating end of a lower body of the interstage seal, and a hook end of the lower body. The method also includes axially constraining the interstage seal using the hook end of the lower body.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

The present disclosure is directed to interstage turbine seal systems that may be employed to reduce fluid leakage between stages of a turbine. The interstage seal system includes features to seal an interstage gap without the use of additional components, such as spacer wheels. According to certain embodiments, the interstage seal system may be supported by the rotors of the turbine without a mid-rotor support. In addition, the interstage seal system may include multiple seating ends that reduce the likelihood or magnitude of radial displacement of the interstage seal system. Additionally, the interstage seal system may include a hook end that reduces the likelihood or magnitude of radial and axial displacement of the interstage seal system. Furthermore, the interstage seal system may reduce the spacing between the rotors of the turbine.

Figure 1:
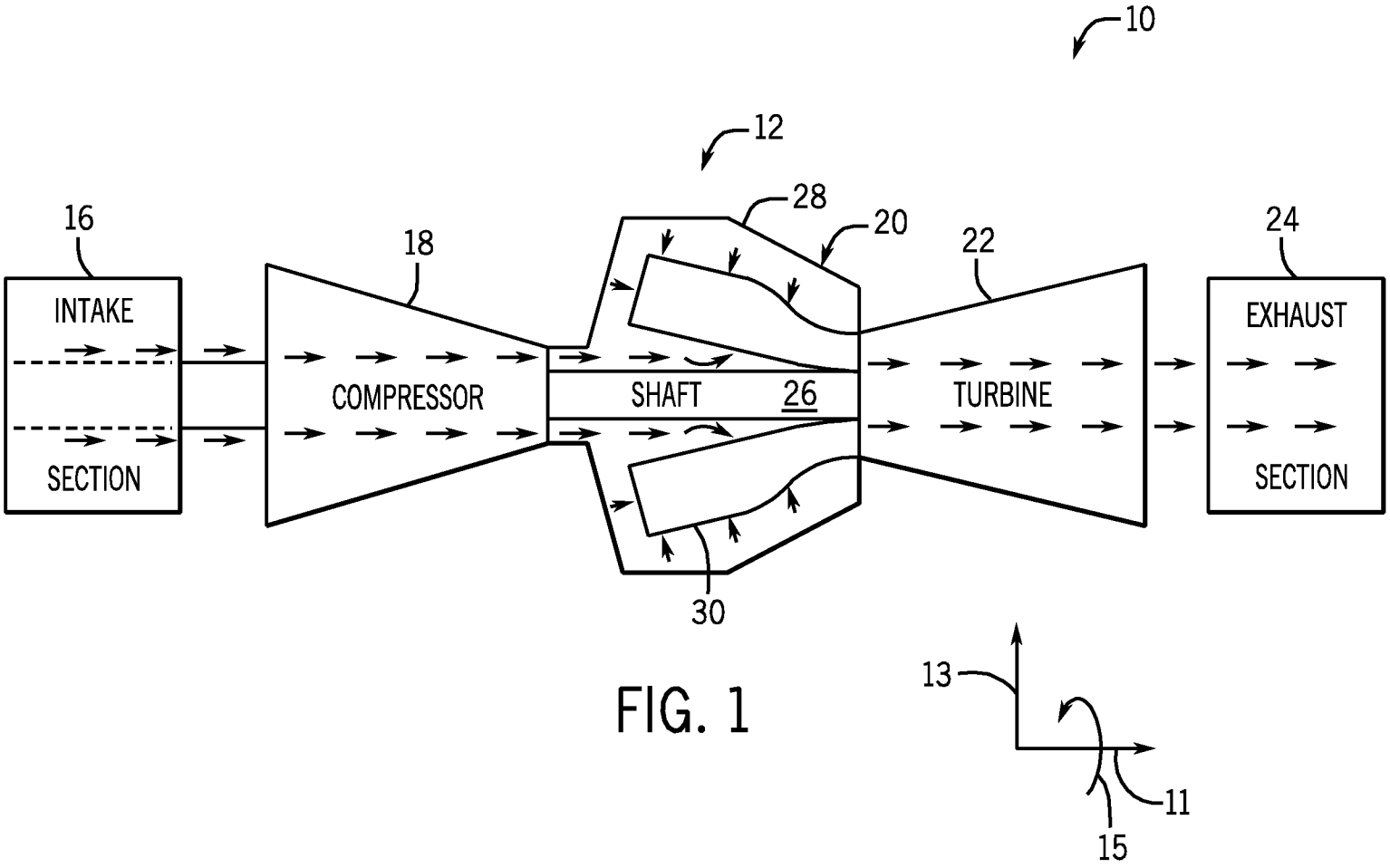
FIG. 1 is a schematic flow diagram of an embodiment of a gas turbine engine that may employ turbine seals in accordance with aspects of the present techniques.

FIG. 1 is a block diagram of an exemplary system 10 including a gas turbine engine 12 that may employ interstage seals as described in detail below. In certain embodiments, the system 10 may include an aircraft, a watercraft, a locomotive, a power generation system, or combinations thereof. The illustrated gas turbine engine 12 includes an air intake section 16, a compressor 18, a combustor section 20, a turbine 22, and an exhaust section 24. The turbine 22 is coupled to the compressor 18 via a shaft 26.

As indicated by the arrows, air may enter the gas turbine engine 12 through the intake section 16 and flow into the compressor 18, which compresses the air prior to entry into the combustor section 20. The illustrated combustor section 20 includes a combustor housing 28 disposed concentrically or annularly about the shaft 26 between the compressor 18 and the turbine 22. The compressed air from the compressor 18 enters combustors 30, where the compressed air may mix and combust with fuel within the combustors 30 to drive the turbine 22.

From the combustor section 20, the hot combustion gases flow through the turbine 22, driving the compressor 18 via the shaft 26. For example, the combustion gases may apply motive forces to turbine rotor blades within the turbine 22 to rotate the shaft 26. After flowing through the turbine 22, the hot combustion gases may exit the gas turbine engine 12 through the exhaust section 24. As discussed below, the turbine 22 may include a plurality of interstage seals, which may reduce the leakage of hot combustion gasses between stages of the turbine 22, and reduce the spacing between rotating components of the turbine 22, such as rotor wheels. Throughout the discussion presented herein, a set of axes will be referenced. These axes are based on a cylindrical coordinate system and point in an axial direction 11, a radial direction 13, and a circumferential direction 15.

Figure 2:
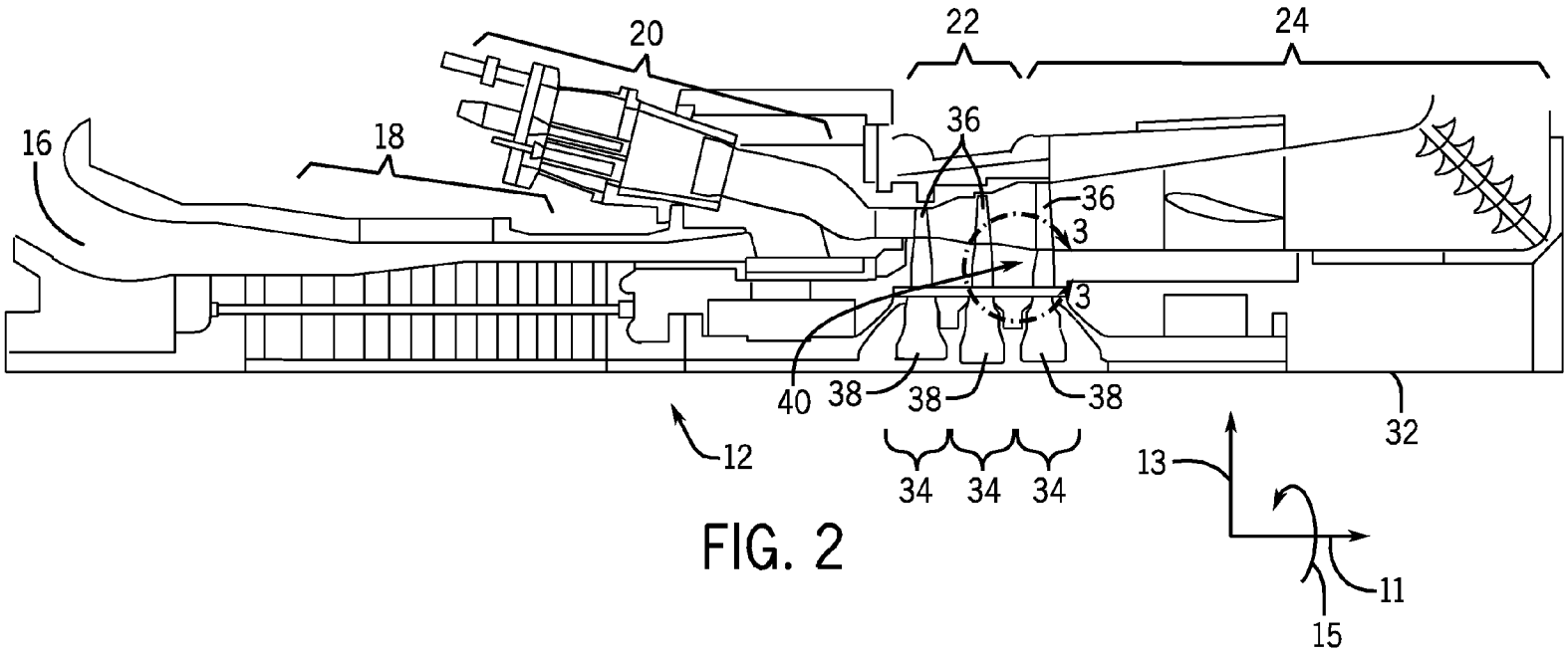
FIG. 2 is a cross-sectional side view of an embodiment of the gas turbine engine of FIG. 1 taken along a longitudinal axis in accordance with aspects of the present techniques.

FIG. 2 is a cross-sectional side view of an embodiment of the gas turbine engine 12 of FIG. 1 taken along a longitudinal axis 32. As depicted, the gas turbine 22 includes three separate stages 34; however, the gas turbine 22 may include any number of stages 34. Each stage 34 includes a set of blades 36 coupled to a rotor wheel 38 that may be rotatably attached to the shaft 26 (FIG. 1). The blades 36 extend radially outward from the rotor wheels 38 and are partially disposed within the path of the hot combustion gases through the turbine 22. As described in greater detail below, interstage seals 42 extend axially between stages 34 and are supported by adjacent rotor wheels 38. As discussed below, the interstage seals 42 may include seating arms and a hook end that fit about adjacent wheels 38 for support. The interstage seals 42 may be designed to reduce the spacing between adjacent rotor wheels 38. In addition, the interstage seals 42 may provide for improved cooling of the stages 34. Although the gas turbine 22 is illustrated as a three-stage turbine, the interstage seals 42 described herein may be employed in any suitable type of turbine with any number of stages and shafts. For example, the interstage seals 42 may be included in a single stage gas turbine, in a dual turbine system that includes a low-pressure turbine and a high-pressure turbine, or in a steam turbine. Further, the interstage seals 42 described herein may also be employed in a rotary compressor, such as the compressor 18 illustrated in FIG. 1. The interstage seals 42 may be made from various high-temperature alloys, such as, but not limited to, nickel based alloys.

As described above with respect to FIG. 1, air enters through the air intake section 16 and is compressed by the compressor 18. The compressed air from the compressor 18 is then directed into the combustor section 20 where the compressed air is mixed with fuel. The mixture of compressed air and fuel is burned within the combustor section 20 to generate high-temperature, high-pressure combustion gases, which are used to generate torque within the turbine 22. Specifically, the combustion gases apply motive forces to the blades 36 to turn the rotor wheels 38. In certain embodiments, a pressure drop may occur at each stage 34 of the turbine 22, which may allow gas leakage flow through unintended paths. For example, the hot combustion gases may leak into interstage volumes between turbine wheels 38, which may place thermal stresses on the turbine components. In certain embodiments, the interstage volumes may be cooled by discharge air bled from the compressor 18 or provided by another source. However, flow of hot combustion gases into the interstage volume may abate the cooling effects. Accordingly, in certain embodiments, the interstage seals 42 may be disposed between adjacent rotor wheels 38 to seal and enclose the interstage volumes from the hot combustion gases. In addition, in certain embodiments, the interstage seals 42 may be configured to direct a cooling fluid to the interstage volumes or from the interstage volumes toward the blades 36.

Figure 3:
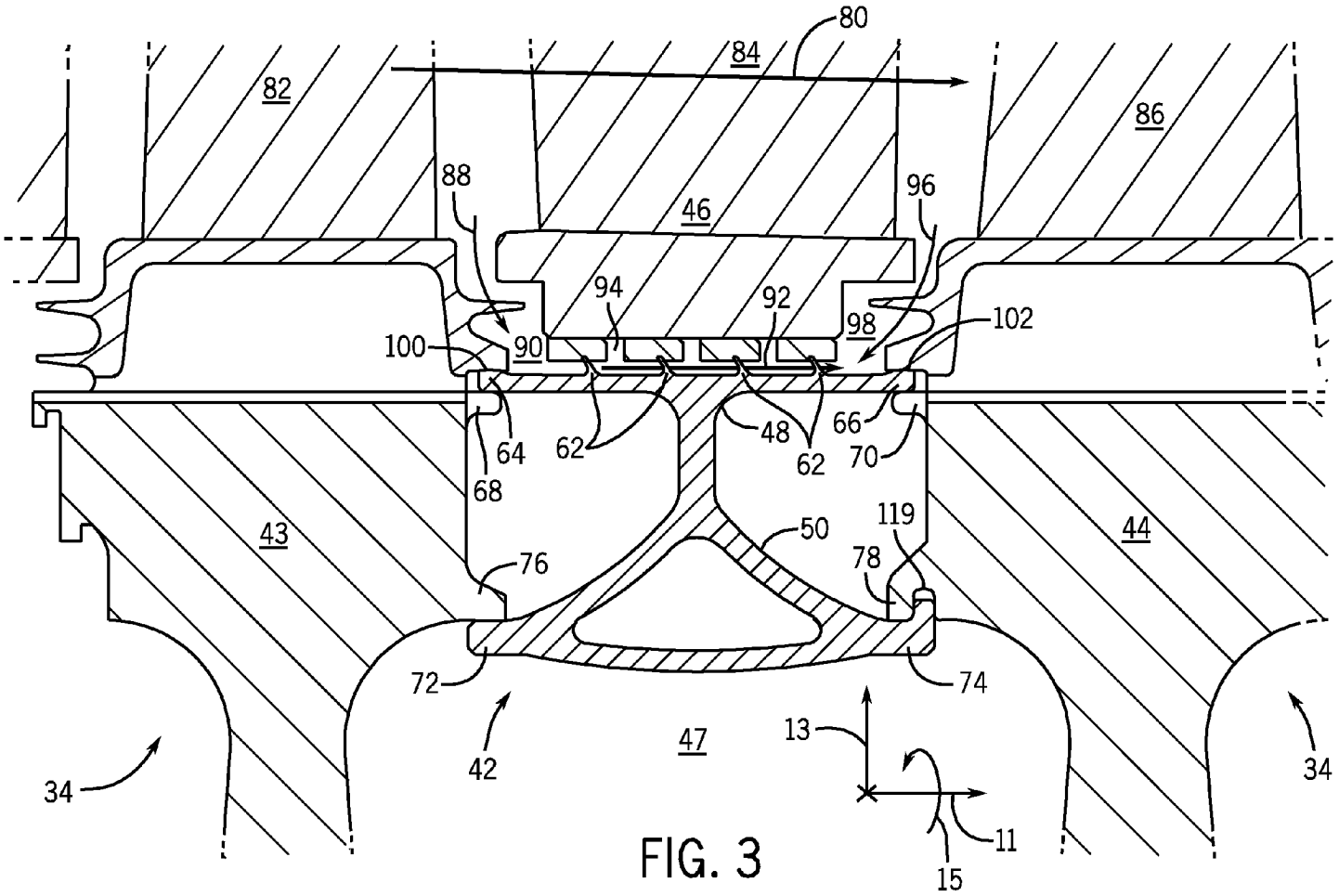
FIG. 3 is a partial cross-sectional side view of the gas turbine engine of FIG. 2 illustrating an embodiment of an interstage seal between turbine stages in accordance with aspects of the present techniques.

FIG. 3 is a partial cross-sectional side view of the gas turbine engine 12 illustrating an embodiment of an interstage seal 42 between two adjacent turbine stages 34. The interstage seal 42 spans longitudinally from an upstream rotor wheel 43 to a downstream rotor wheel 44. Additionally, the interstage seal 42 is disposed radially between a nozzle 46 and the shaft 26 in a rotor cavity 47. As illustrated in FIG. 3, the rotor cavity 47 is unobstructed by a spacer component (e.g. a mid-rotor support). Thus, internal components of the rotor may be more easily accessed compared to a turbine 22 that includes a mid-rotor support. Further, the interstage seal 42 may be entirely radially supported by the upstream and downstream rotor wheels 43, 44. As described above, the interstage seal 42 is positioned to reduce leakage of hot gas through unintended paths between the rotor wheels 43, 44. The interstage seal 42 illustrated in FIG. 3 includes an upper body 48 and a lower body 50. Generally speaking, the upper body 48 primarily provides a sealing function to isolate the rotor cavity 47 from the hot gas, whereas the lower body 50 primarily reduces or inhibits the movement of the interstage seal 42 in the axial direction 11 and the radial direction 13.

As illustrated in FIG. 3, in certain embodiments, the upper body 48 includes sealing teeth 62, an upstream seating arm 64, and a downstream seating arm 66. The upper body 48 extends from the upstream seating arm 64 to the downstream seating arm 66. The upstream seating arm 64 rests on an upper radial support 68 that extends axially from a turbine bucket 82. The upstream seating arm 64, along with the upper radial support 68, reduces the likelihood or magnitude of radial movement of the interstage seal 42 toward the shaft 26 of the gas turbine engine 12. The downstream seating arm 66 similarly rests on an upper radial support 70 that extends axially from a turbine bucket 86. Similarly, downstream seating arm 66, along with the upper radial support 70, reduces the likelihood or magnitude of radial movement of the interstage seal 42 toward the shaft 26 of the gas turbine engine 12. In certain embodiments, the seating arms 64, 66 may be flexible relative to the lower body 50. Thus, when the gas turbine engine 12 is operating, the seating arms 64, 66 may constrain movement of the interstage seal 42 along the radial direction 13.

As illustrated in FIG. 3, the lower body 50 includes an upstream seating end 72 and a downstream hook end 74. The lower body 50 extends longitudinally from the upstream seating end to the downstream hook end 74. The upstream seating end 72 is disposed at a lower radial support 76 that extends axially from the downstream rotor wheel 43. The upstream seating end 72, along with the lower radial support 76, reduces the likelihood or magnitude of radial movement of the interstage seal 42 away from the shaft 26 of the gas turbine engine 12. Thus, the upstream seating end 72 may constrain movement of the interstage seal 42 along the radial direction 13. The downstream hook end 74 is disposed proximate to a hook support 78 that extends axially from the downstream rotor wheel 44. The hook end 74, along with the hook support 78 (e.g. a lower support), reduces the likelihood or magnitude of axial and radial movement of the interstage seal 42. Thus, the hook end 74 may constrain movement of the interstage seal 42 along the radial direction 13 and the axial direction 11. In general, the upstream side of the interstage seal 42 is radially attached to the upstream rotor wheel 43, whereas the downstream side of the interstage seal 42 is axially and radially constrained by the hook support 78. In other embodiments, the lower body 50 may include a hook end disposed proximate to a hook support that extends from the upstream rotor wheel 43. Further, in other embodiments, the lower body 50 may include multiple hook ends disposed at multiple hook supports (e.g., one upstream and one downstream), which may further reduce the likelihood or magnitude of axial and radial movement of the interstage seal 42.

When the gas turbine engine 12 is in operation, hot gas may flow through the turbine 22 and generally take a path as indicated by arrow 80. More specifically, the hot gas may flow across the first, upstream turbine bucket 82 attached to the upstream rotor wheel 43, the nozzle 46, and a second, downstream turbine bucket 86 attached to the downstream rotor wheel 44. However, a portion of the hot gas may be ingested toward the rotor cavity 47 along a path as indicated by arrow 88. The ingested hot gas may collect in a region 90 between the upstream turbine bucket 82 and the nozzle 46. Some of the hot gas may attempt to leak across the nozzle 46 along a path as indicated by arrow 92. The hot gas leakage may decrease the efficiency of the gas turbine 12. Thus, the interstage seals 42 described herein reduce hot gas leakage along arrow 92 and maximize the main hot gas flow along arrow 80.

A static seal 94 is disposed radially between the nozzle 46 and the interstage seal 42. The sealing teeth 62 of the upper body 48 may form a portion of the static seal 94. The static seal 94 may inhibit hot gas leakage along arrow 92. For example, in certain embodiments, the sealing teeth 62 may form a labyrinth seal with the static seal 94. The labyrinth seal may provide a tortuous path for the hot gas. As a result, the hot gas may preferentially flow along arrow 80 through the turbine 22 rather than along arrow 92. When the gas turbine engine 12 is in operation, a portion of the hot gas may also be ingested toward the rotor cavity 47 along a path as indicated by arrow 96. The ingested hot gas may collect in a region 98 between the downstream turbine bucket 86 and the nozzle 46. The static seal 94 may also reduce hot gas leakage from the downstream region 98 to the upstream region 90.

Additionally, the static seal 94 may isolate the rotor cavity 47 from the hot gas flow. Specifically, the regions 90, 98 may be isolated from the rotor cavity 47 by the interstage seal 42. For example, the upper radial support 68 of the bucket 82 forms a seal 100 with the upstream seating arm 64 of the upper body 48 of the interstage seal 42. The seal 100 may reduce the leakage of hot gas radially into the rotor cavity 47. Additionally, the upper radial support 70 of the bucket 86 forms a seal 102 with the downstream seating arm 66 of the upper body 48 of the interstage seal 42. The seal 102 may also reduce the leakage of hot gas radially into the rotor cavity 47.

In certain embodiments, the turbine 22 may include cooling and leakage air to cool internal components of the turbine 22. The cooling and leakage air may flow through the rotor cavity 47 to cool the upstream rotor wheel 43, the downstream rotor wheel 44, and the interstage seal 42. The cooling and leakage air may also be provided to the hook end 74. In such an embodiment, the seals 94, 100, 102 may also isolate the hot gas flow paths from the cooling and leakage air.

Figure 4:
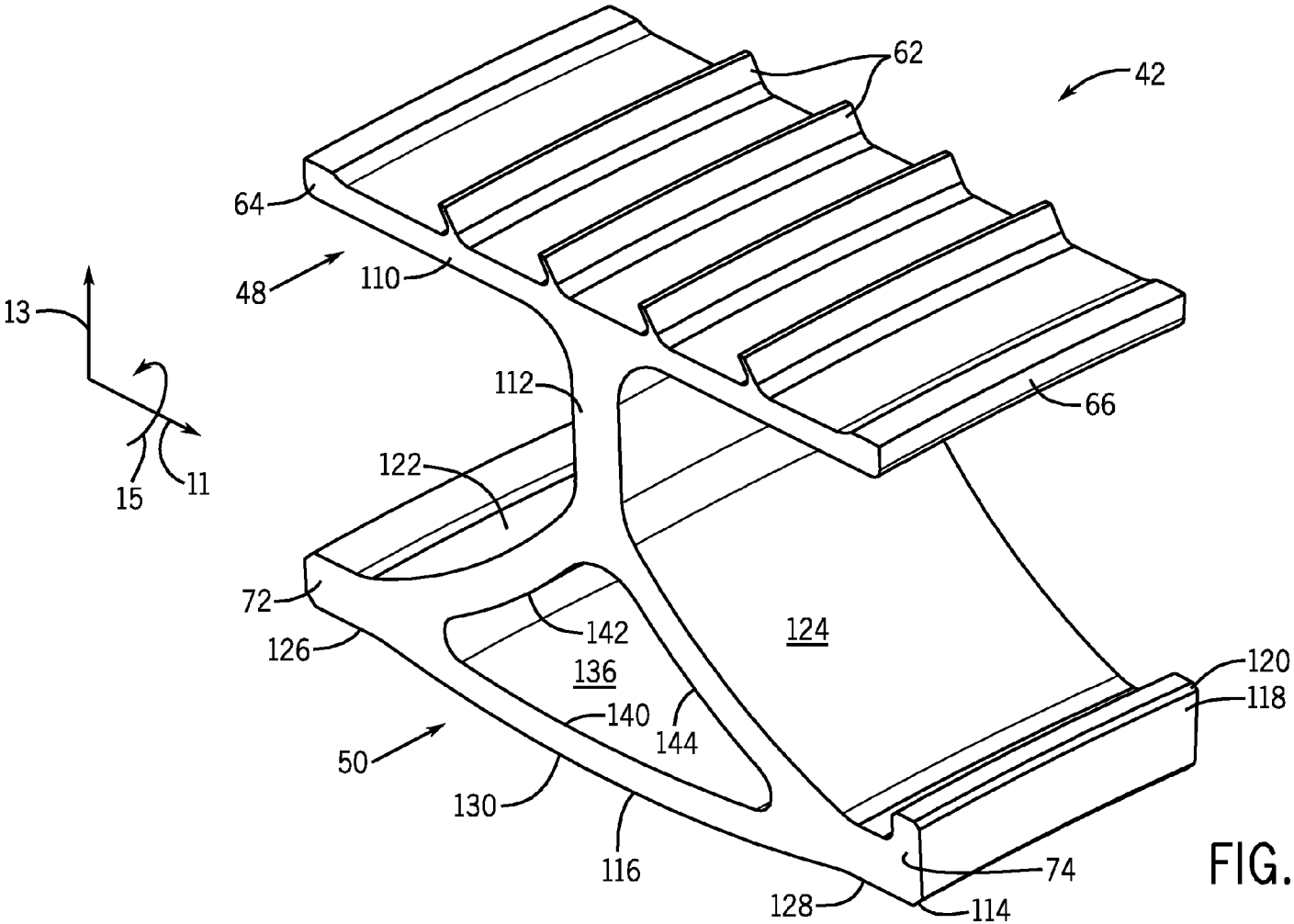
FIG. 4 is a perspective view of an embodiment of the interstage seal of FIG. 3 in accordance with aspects of the present techniques.

FIG. 4 is a perspective view of an embodiment of the interstage seal 42 that may reduce the spacing between the rotors of the turbine 22 and may not require mid-rotor support. As described above, the interstage seal 42 includes the upper body 48 and the lower body 50. As illustrated, the upper body 48 is substantially T-shaped and the lower body 50 is substantially triangular. In other embodiments, the general shapes of the upper body 48 and the lower body 50 may vary. For example, the upper body 48 may be substantially rectangular, and the main body 50 may be substantially circular.

The upper body 48 illustrated in FIG. 4 includes a substantially linear sealing portion 110 and a neck portion 112 that is substantially perpendicular to the sealing portion 110, thereby forming the T-shape. The sealing portion 110 is substantially rectangular in shape. In other embodiments, the sealing portion 110 may be somewhat arcuate in shape. As described above, the sealing portion 110 extends axially from the upstream seating arm 64 to the downstream seating arm 66. The sealing teeth 62 are disposed radially outward from the sealing portion 110. In other words, the sealing teeth extend radially outward on a side of the sealing portion 110 opposite the lower body 50. The neck portion 112 extends between the sealing portion 110 and the lower body 50. The length of neck portion 112 may vary between embodiments. Other embodiments of the interstage seal 42 may not even include the neck portion 112. For example, the sealing portion 110 may be disposed directly adjacent to the lower body 50, and may not include the neck portion 112.

As described above, the lower body 50 includes the seating end 72 and the hook end 74. The hook end 74 forms an edge 114 with a base 116 of the lower body 50. As illustrated, in certain embodiments, the edge 114 is chamfered. In other embodiments, the edge 114 may be rounded, straight, or have another suitable shape. The hook end 74 includes a protrusion 118 that extends crosswise relative to the base 116. More specifically, the protrusion 118 may extend towards the downstream seating arm 66 of the upper body 48. The protrusion 118 is designed to fit within a corresponding groove 119 adjacent the hook support 78 of the downstream rotor wheel 44 (FIG. 3). In addition, in certain embodiments, the protrusion 118 may include a chamfered edge 120. In other embodiments, the protrusion 118 may include a rounded edge or another suitable shape that may fit with within the hook support 78 of the downstream rotor wheel 44 (FIG. 3). Additionally, in certain embodiments, the protrusion 118 may extend the entire length of the hook end 74, as illustrated. In other embodiments, the protrusion 118 may extend along a portion of the length of the hook end 74. In yet other embodiments, the hook end 74 may include multiple protrusions, such as 1, 2, 3, 4, 5, 6, or more protrusions that each extends along a portion of the hook end 74. In certain embodiments, these protrusions may be integrally formed with the hook end 74 as a one-piece structure.

As illustrated, the lower body 50 also includes first and second sides 122, 124, wherein the first side 122 extends from the neck portion 112 to the upstream seating end 72 and the second side 124 extends from the neck portion 112 to the downstream hook end 74. As described above, the base 116 extends from the upstream seating end 72 to the downstream hook end 74 (e.g. from the first side 122 to the second side 124). Thus, the sides 122, 124, and the base 116 may be disposed in a generally triangular arrangement about lower body 50. In other embodiments, the sides may be disposed in a generally circular, trapezoidal, or otherwise polygonal arrangement. In addition, other embodiments may have a different number of sides or bases. For example, the lower body 50 of the interstage seal 42 may have three sides and one base in a rectangular arrangement. Further, the shapes of the sides 122, 124 and the base 116 may vary among embodiments. For example, as illustrated in FIG. 4, the sides 122, 124 have generally catenary shapes. In addition, the base 116 includes two substantially straight regions 126,128 proximate to the upstream seating end 72 and the downstream hook end 74, respectively, and an arcuate region 130 disposed between the substantially straight regions 126, 128. The substantially straight regions 126, 128 are generally parallel to the sealing portion 110. As illustrated, the arcuate region 130 may also have a generally catenary shape. In other embodiments, the base 116 may include a different combination of substantially straight and arcuate regions to form a different shape. In addition, the shapes of the sides 122, 124, and the base 116 may vary and may, for example, be parabolic, elliptical, straight, curved, or another suitable shape. Further, the shapes may vary among the sides 122, 124, and the base 116. For example, the first side 122 may be straight, the second side 124 may be parabolic, and the base 116 may be elliptical. However, in certain embodiments, to enable the interstage seal 42 to support the radial and axial forces generated between the upstream and downstream rotor wheels 43, 44, both the upper and lower bodies 48, 50 of the interstage seal 42 may typically be generally symmetrical in the radial direction 13.

The lower body 50 illustrated in FIG. 4 also includes a hollow region 136, which includes a base 140, a first side 142, and a second side 144. The shape of the base 140 generally corresponds to the shape of the base 116, the shape of first side 142 generally corresponds to the shape of the first side 122, and the shape of second side 144 generally corresponds to the shape of the second side 124. Thus, the sides 142, 144, and the base 140 may have generally catenary shapes. In other embodiments, the shape of the sides 142, 144, and the base 140 may vary. For example, the first side 142 may be straight, the second side 144 may be parabolic, and the base 140 may be circular. However, again, to enable the interstage seal 42 to support the radial and axial forces generated between the upstream and downstream rotor wheels 43, 44, both the upper and lower bodies 48, 50 of the interstage seal 42 may typically be generally symmetrical in the radial direction 13.

Further, in certain embodiments, the shape of the sides 142, 144, and the base 140 may not correspond to the shape of the sides 122, 124, and the base 116. As illustrated, the sides 142, 144, and the base 140 are disposed in a triangular arrangement about the hollow region 136. In other embodiments, the arrangement of the sides 142, 144, and the base 140 may vary. For example, the sides and the base of hollow region 136 may be arranged in a circular or trapezoidal shape. Additionally, certain embodiments may include a different number of hollow regions 136. For example, the interstage seal 42 may include 1, 2, 3, 4, 5, 6, or more hollow regions 136. Indeed, in certain embodiments, the interstage seal 42 may not include the hollow region 136.

As may be appreciated, the shape and structure of the upper body 48 and the lower body 50 may vary substantially between embodiments. Additional embodiments are discussed further below with respect to FIG. 6 through FIG. 11. The alternative shapes of the upper body 48 and the lower body 50 illustrated in FIGS. 6 through 11 are provided by way of example, and are not intended to be limiting. In addition, as may be appreciated, the design considerations described above with respect to FIGS. 3 and 4 may be extended to the embodiments illustrated in FIGS. 6 through 11.

Figure 5:
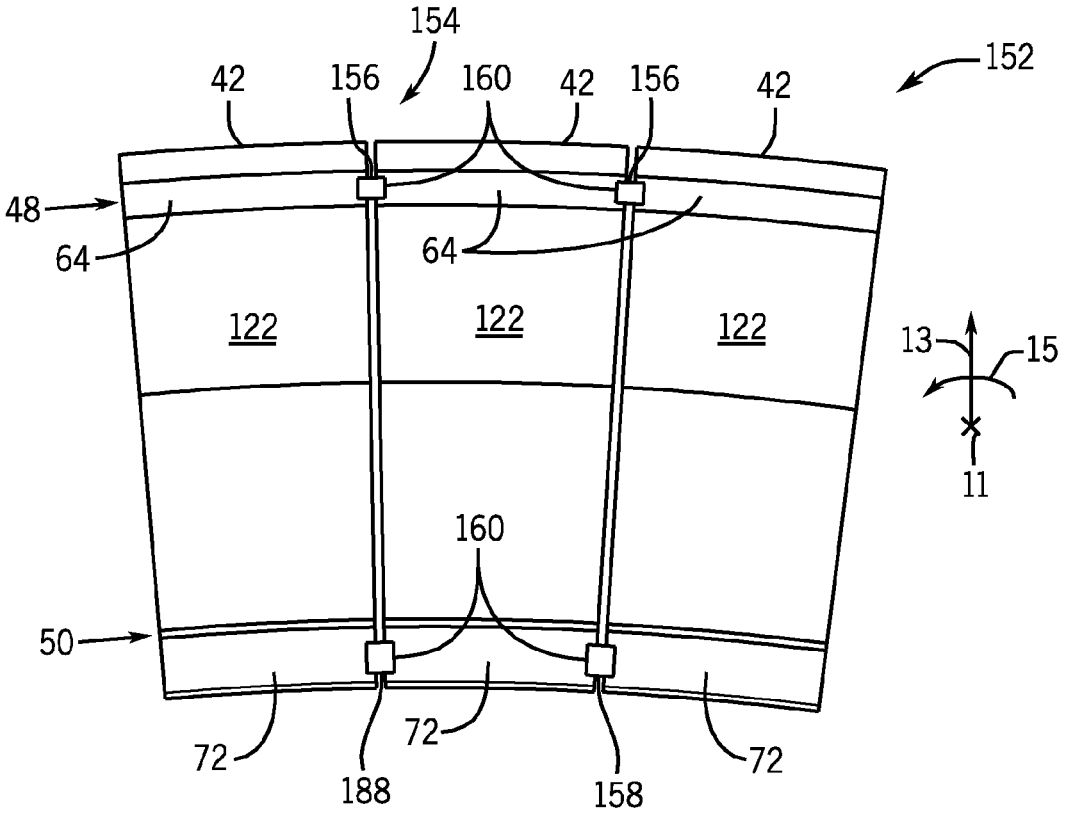
FIG. 5 is a side view of an embodiment of circumferentially adjacent interstage seals in accordance with aspects of the present techniques.

FIG. 5 is a side view of three substantially identical, adjacent interstage seals 42 of FIG. 4 facing the side 122. FIG. 5 illustrates how adjacent sections of the interstage seals 42 may be attached together to form seals between adjacent stages of the gas turbine engine 12. The three interstage seals 42 may form a portion of a seal assembly 152. The seal assembly 152 may include multiple interstage seals 42 disposed adjacent to one another to form a 360-degree ring about the shaft 26 of the gas turbine engine 12. Further, the cross-sectional profiles of the adjacent interstage seals 42 may abut at similar locations, as illustrated. The number of interstage seals 42 that form the seal assembly 152 may range from approximately 2 to 100, or 10 to 80, or 42 to 50. As illustrated, each of the interstage seals 42 is arcuate in the circumferential direction 15. In certain embodiments, a gap 154 may exist between adjacent interstage seals 42. Accordingly, the seal assembly 152 may include outer seals 156 and inner seals 158 disposed in the gaps 154 between interstage seals 42. As illustrated, the outer seal 156 may be disposed between the upper bodies 48 of the interstage seals 42. The outer seal 156 extends from the upstream seating arm 64 to the downstream seating arm 66. The inner seal 158 may be disposed between the lower bodies 50 of the interstage seals 42. The inner seal 158 extends from the upstream seating end 72 to the downstream hook end 74. The outer seals 156 and the inner seals 158 may reduce the likelihood or impact of radial gas leakage through the gaps 154. In addition, in certain embodiments, axial slots 160 may be formed in the interstage seals 42 to accommodate the outer seals 156 and the inner seals 158. In certain embodiments, the outer seals 156 and/or the inner seals 158 may be disposed along different regions of the interstage seals 42. In addition, the seal assembly 152 may include a different number or a different arrangement of outer seals 156 and/or inner seals 158. For example, a seal assembly 152 may include 1, 2, 3, 4, or more outer seals 156 disposed between each adjacent pair of interstage seals 42. In addition, in certain embodiments, the seal assembly 152 may not include the inner seals 158.

Figure 6:
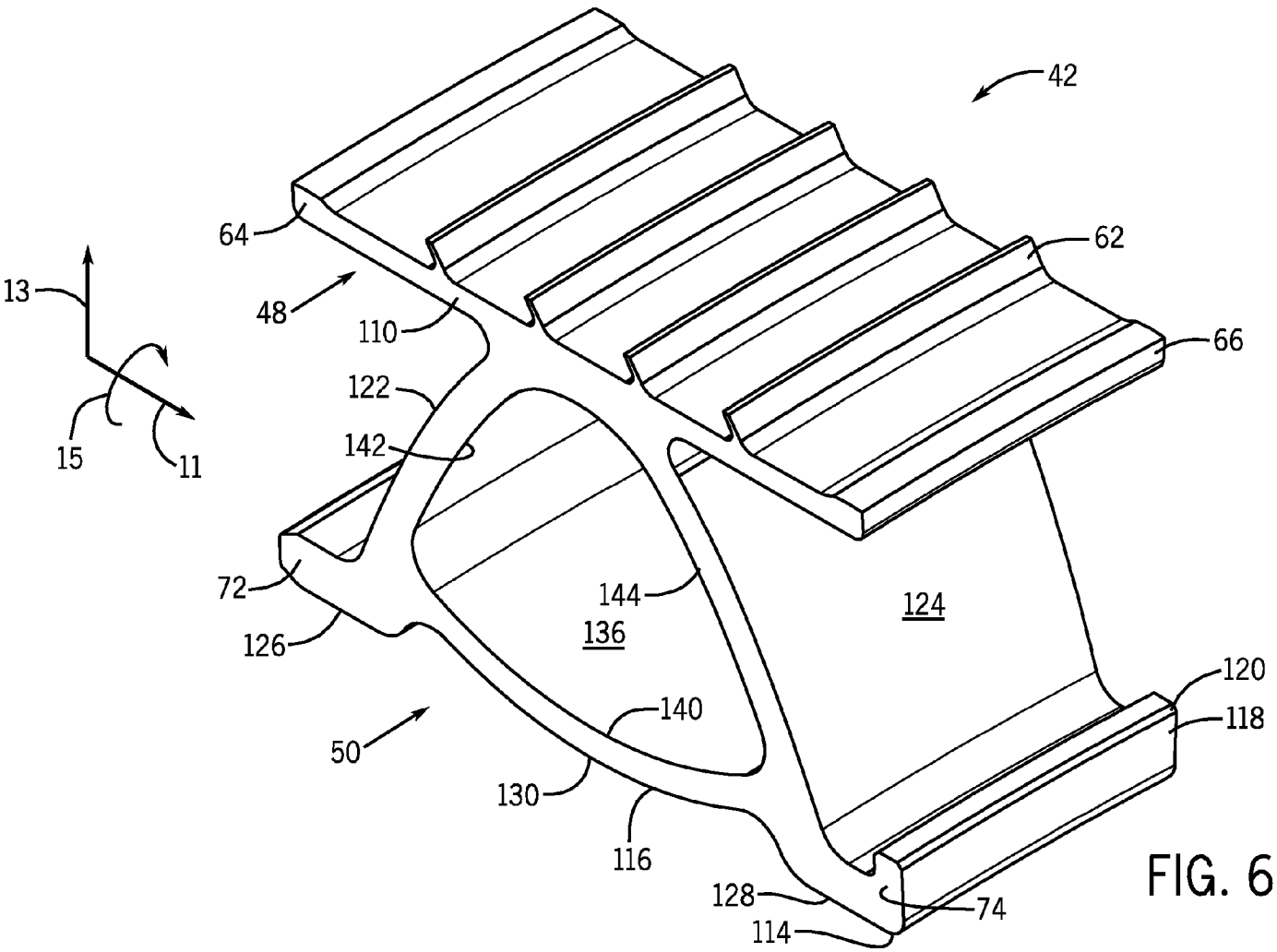
FIG. 6 is perspective view of an embodiment of an interstage seal in accordance with aspects of the present techniques.

FIG. 6 is a perspective view of another embodiment of the interstage seal 42 that may reduce the spacing between the rotors of the turbine 22 and may not require mid-rotor support. The interstage seal 42 includes the upper body 48 and the lower body 50. As illustrated, the upper body 48 is substantially rectangular in shape and the lower body 50 is substantially triangular in shape. The upper body 48 includes the substantially linear sealing portion 110, which is substantially rectangular in shape and extends from the upstream seating arm 64 to the downstream seating arm 66. In addition, the sealing portion 110 includes the sealing teeth 62. As illustrated, the interstage seal 42 does not include the neck portion 112 of the embodiment illustrated in FIGS. 3 and 4. Instead, the sealing portion 110 is disposed directly adjacent to the lower body 50.

The lower body 50 includes the base 116, the first side 122, and the second side 124. The base 116 has a complex shape that includes substantially straight portions 126, 128 and an arcuate region 130 that extends between the substantially straight portions 126, 128. The first side 122 extends from the sealing portion 110 to the substantially straight portion 126 proximate to the upstream seating end 72, whereas the second side 124 extends from the sealing portion 110 to the substantially straight portion 128 proximate to downstream hook end 74. The substantially straight portion 128 forms an edge 114 with the downstream hook end 74. As illustrated, in certain embodiments, the edge 114 may be rounded. As also illustrated, the sides 122, 124 have a generally arcuate shape. The interstage seal 42 also includes the hollow region 136, which includes the base 140, the first side 142, and the second side 144. In certain embodiments, the shape of the base 140 generally corresponds to the shape of the arcuate region 130 of the base 116. Additionally, the shape of the first side 142 generally corresponds to the shape of first side 122, and the shape of second side 144 generally corresponds to the shape of second side 124. Thus, the sides 142, 144, and the base 140 may have generally arcuate shapes.

Figure 7:
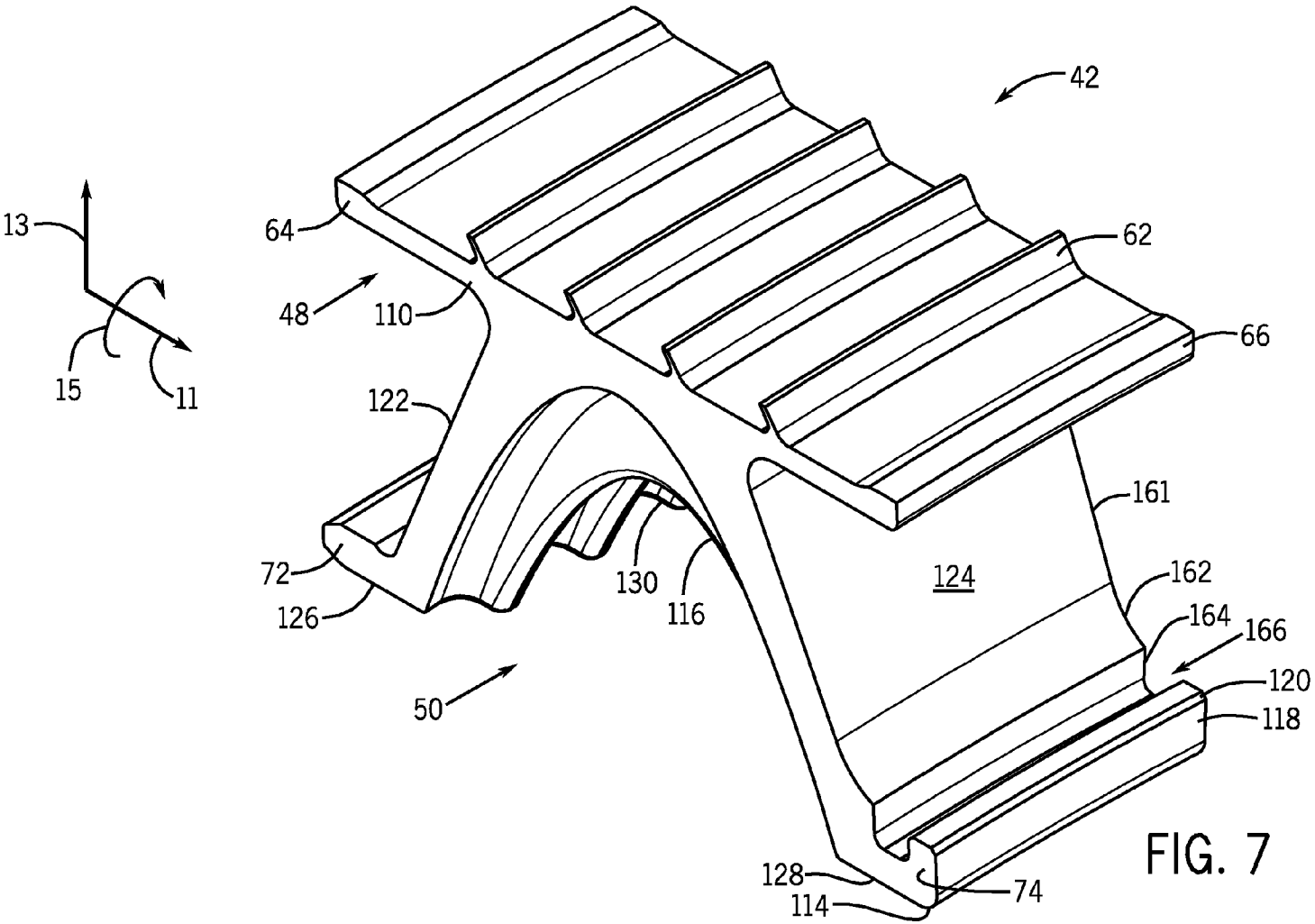
FIG. 7 is perspective view of an embodiment of an interstage seal in accordance with aspects of the present techniques.

FIG. 7 is a perspective view of another embodiment of the interstage seal 42 that may reduce the spacing between the rotors of the turbine 22 and may not require mid-rotor support. The interstage seal 42 includes the upper body 48 and the lower body 50. As illustrated, the upper body 48 is substantially rectangular in shape and the lower body 50 is substantially arcuate in shape. The upper body 48 includes the sealing portion 110. As illustrated, the interstage seal 42 does not include the neck portion 112 of the embodiment illustrated in FIGS. 3 and 4. Instead, the sealing portion 110 is disposed directly adjacent to the lower body 50. Main body 50 includes the base 116, the first side 122, and the second side 124. In the illustrated embodiment, the base 116 has a complex shape that includes substantially straight portions 126, 128, and a substantially arcuate portion 130 that extends between the substantially straight portions 126, 128. As shown, the arcuate portion 130 extends above the substantially straight portions 126, 128. The first side 122 has a substantially straight shape that extends from the sealing portion 110 to the substantially straight portion 126 proximate to the upstream seating end 72. The second side 124 has a complex shape that extends from the sealing portion 110 to the substantially straight portion 128 proximate to the downstream hook end 74. More specifically, the second side 124 includes a first substantially straight portion 161, an arcuate portion 162 extending from the first substantially straight portion 161, and a second substantially straight portion 164 extending from the arcuate portion 162. In other embodiments, the second side 124 may include a different combination of straight and arcuate portions. The second substantially straight portion 164 is approximately parallel to the protrusion 118. In other embodiments, the second substantially straight portion 164 may be crosswise relative to protrusion 118. A depression 166 extends between the second substantially straight portion 164 and the protrusion 118. The depression 166 may be designed to accommodate the downstream hook support 78 (FIG. 3). Notably, the lower body 50 does not include a hollow region 136. Rather, the lower body 50 primarily consists of the first and second sides, 122, 124 and the substantially straight portions 126, 128, which include the upstream seating end 72 and the downstream hook end 74, respectively.

Figure 8:
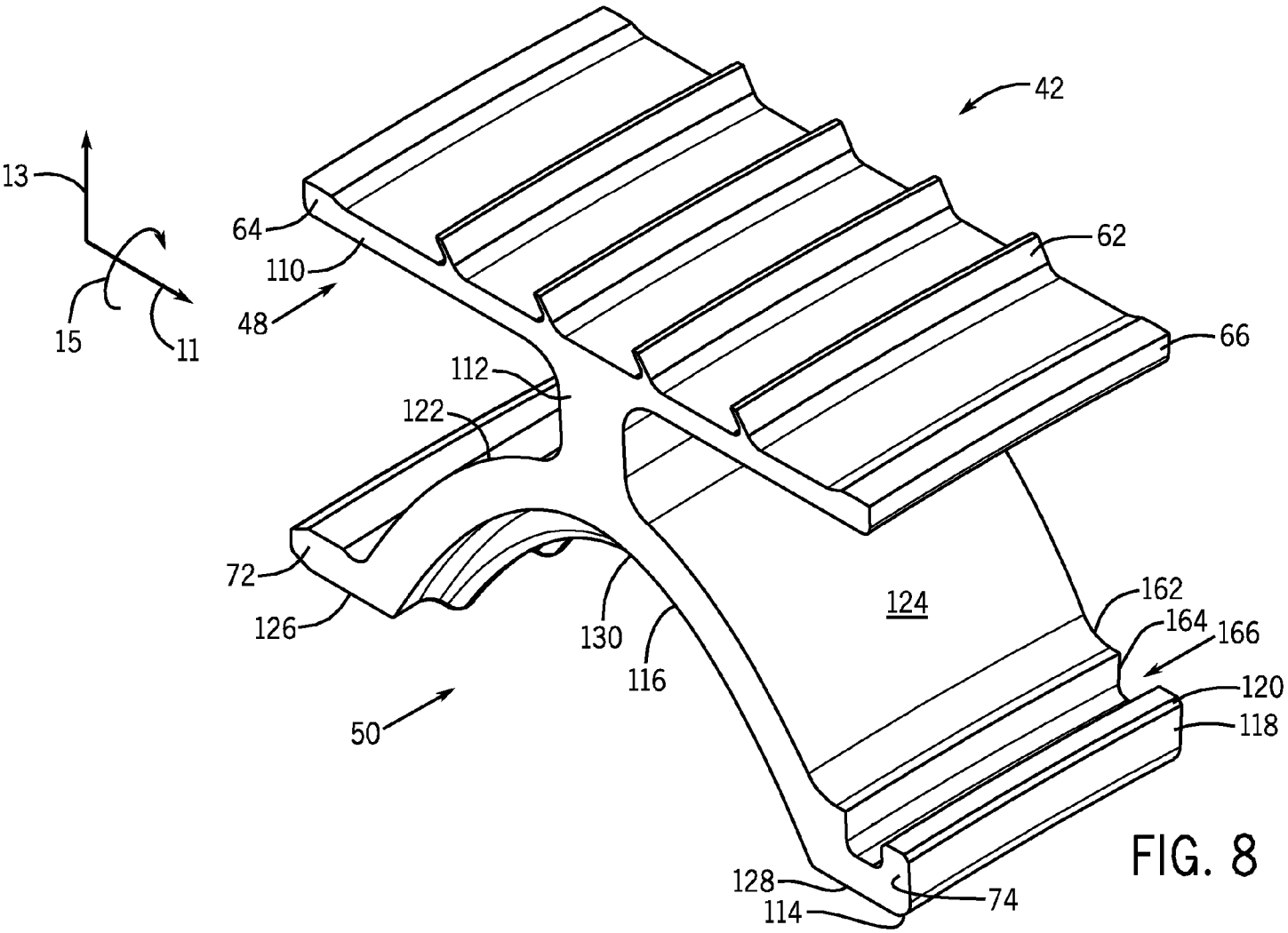
FIG. 8 is perspective view of an embodiment of an interstage seal in accordance with aspects of the present techniques.

FIG. 8 is perspective view of another embodiment of the interstage seal 42 that may reduce the spacing between the rotors of the turbine 22 and may not require mid-rotor support. The interstage seal 42 illustrated in FIG. 8 is substantially similar to the interstage seal 42 illustrated in FIG. 7 except for the fact that the interstage seal 42 includes the neck portion between the sealing portion 110 and the first and second sides 122, 124. More specifically, the interstage seal 42 includes the upper body 48 and the lower body 50. As illustrated, the upper body 48 is substantially rectangular in shape and the lower body 50 is substantially arcuate in shape. The upper body 48 includes the sealing portion 110, and the neck portion 112 extends between the sealing portion 110 and the lower body 50. The lower body 50 includes the base 116, the first side 122, and the second side 124. In addition, similar to the embodiment illustrated in FIG. 7, the lower body 50 does not include the hollow region 136. Rather, the first and second sides 122, 124 have an arcuate shape. The curvature of sides 122, 124 may be implementation-specific and may vary between embodiments.

Figure 9:
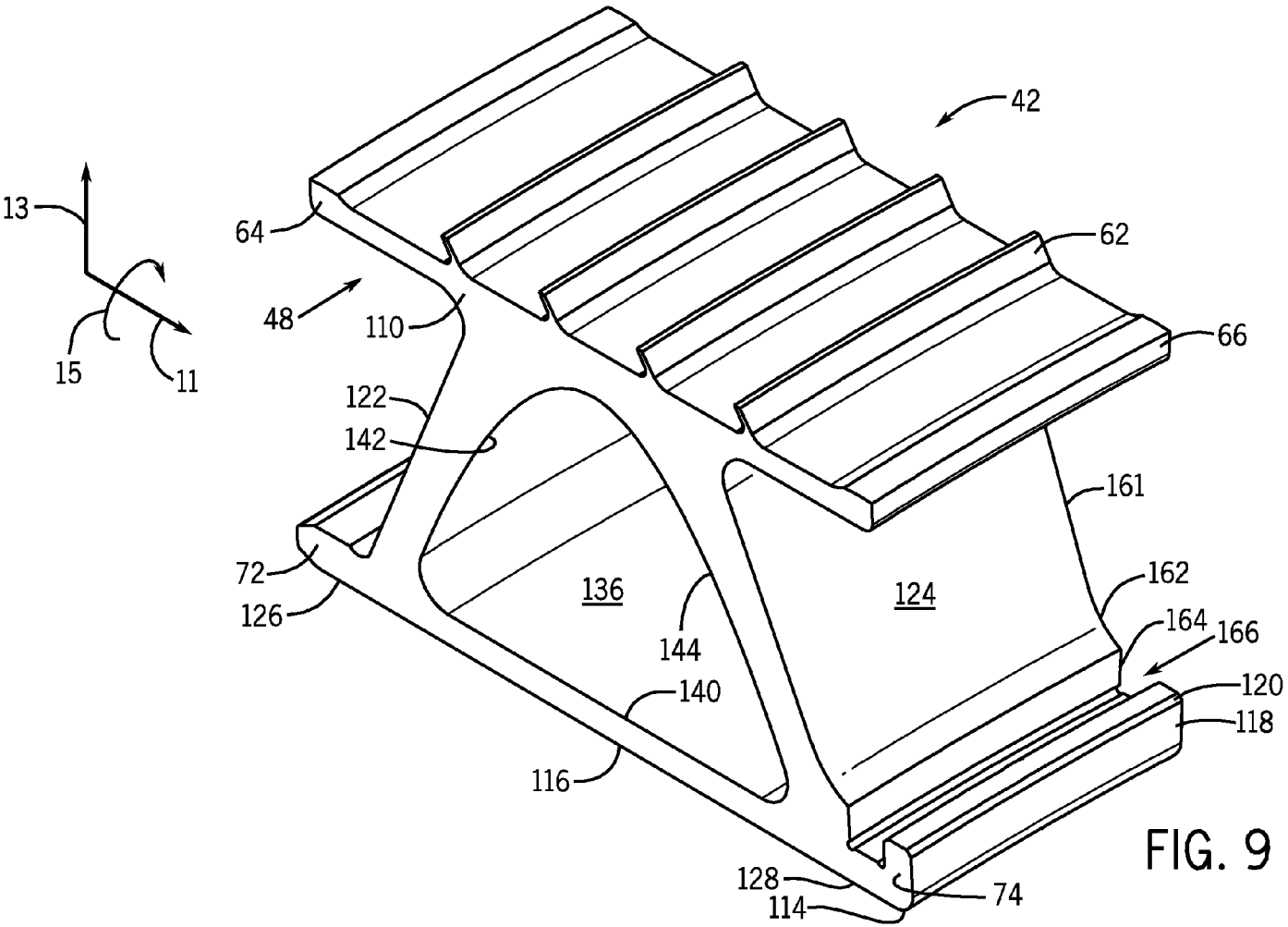
FIG. 9 is perspective view of an embodiment of an interstage seal in accordance with aspects of the present techniques.

FIG. 9 is a perspective view of another embodiment of the interstage seal 42 that may reduce the spacing between the rotors of the turbine 22 and may not require mid-rotor support. The interstage seal 42 illustrated in FIG. 9 is substantially similar to the interstage seal 42 illustrated in FIG. 7 except for the fact that the base 116 is a substantially straight portion that extends from the substantially straight portions 126, 128 that are proximate the upstream seating end 72 and the downstream hook end 74, respectively. More specifically, the interstage seal 42 includes the upper body 48 and the lower body 50. The upper body 48 does not include the neck portion 112. However, the lower body 50 includes the base 116 and the hollow region 136. As illustrated, the base 116 is substantially straight between the upstream seating end 72 and the downstream hook end 74. Thus, the base 116 does not include the substantially arcuate portion 130 (e.g., as illustrated in FIGS. 7 and 8) between the substantially straight ends 126,128. The base 140 of the hollow region 136 is also substantially straight and may generally follow the shape of the base 116.

Figure 10:
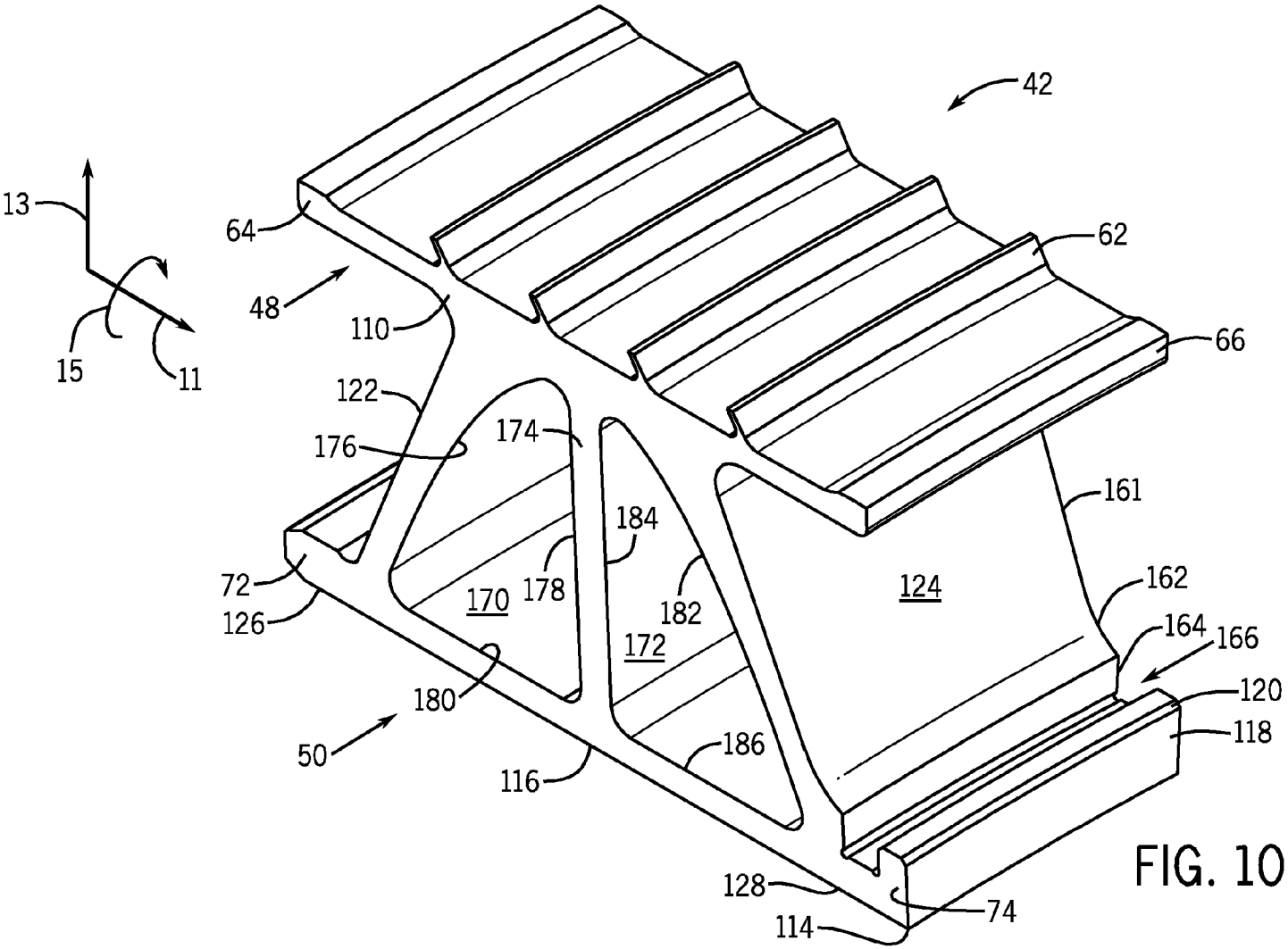
FIG. 10 is perspective view of an embodiment of an interstage seal in accordance with aspects of the present techniques.

FIG. 10 is a perspective view of another embodiment of the interstage seal 42 that may reduce the spacing between the rotors of the turbine 22 and may not require mid-rotor support. The interstage seal 42 illustrated in FIG. 10 is substantially similar to the interstage seal 42 illustrated in FIG. 9 except for the fact that interstage seal 42 includes a central support 174 from the sealing portion 110 to the base 116. More specifically, the interstage seal 42 includes the upper body 48 and the lower body 50. The upper body 48 does not include the neck portion 112. However, the lower body 50 includes the first and second sides 122, 124, and the base 116. As illustrated, the base 116 is substantially straight between the upstream seating end 72 and the downstream hook end 74. In the embodiment illustrated in FIG. 10, the lower body 50 includes two hollow regions 170,172. As illustrated, the hollow regions 170, 172 are approximately symmetric about the central support 174. The central support 174 is substantially straight and extends perpendicularly from the sealing portion 110 to the base 116 of the interstage seal 42. The central support 174 is disposed proximate to the center of the interstage seal 42 between the hollow regions 170, 172.

The first hollow region 170 includes a first side 176, a second side 178, and a base 180. As illustrated, the first side 176 has an arcuate shape that is slightly different than the shape of the first side 122. The second side 178 is substantially straight and may follow the shape of the central support 174. The base 180 is also substantially straight and may generally correspond to the shape of the base 116. As may be appreciated, the shape of the sides 176, 178, and the base 180 may vary among implementations. The second hollow region 172 includes a first side 182, a second side 184, and a base 186. The first side 182 has an arcuate shape that is slightly different than the shape of the second side 124. The second side 184 is substantially straight and may follow the shape of the central support 174. The base 186 is also substantially straight and may generally correspond to the shape of the base 116. As illustrated, the bases 180, 186, the first sides 176, 182, and the second sides 178, 184 are symmetrical about the central support 174. In other embodiments, the hollow regions 170, 172 may have different shapes such that the hollow regions 170, 172 are not symmetrical about the central support 174.

Technical effects of the disclosed embodiments include a seal system for reducing radial leakage between stages of a turbine. The interstage seal system may include multiple seating arms that may reduce the likelihood or magnitude of radial displacement of the seal system. Additionally, the interstage seal system may include a hook end that may reduce the likelihood or magnitude of radial and axial displacement of the seal system. The interstage seal system may reduce the spacing between the rotors wheels of the turbine. Additionally, the interstage seals may not require mid-rotor support. The shapes of the interstage seals may make internal components of the turbine more easily accessible.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A system, comprising:

a multi-stage turbine, comprising:

an interstage seal extending in an axial direction relative to a rotational axis of the multi-stage turbine between a first turbine stage and a second turbine stage, wherein the interstage seal comprises:

an upper body extending from an upstream seating arm to a downstream seating arm, wherein the upstream and downstream seating arms are configured to constrain movement of the interstage seal along a radial direction relative to the rotational axis of the multi-stage turbine; and a lower body extending from a seating end to a hook end, wherein the seating end is configured to constrain movement of the interstage seal along the radial direction, and the hook end comprises an integral protrusion extending crosswise relative to a base of the lower body, wherein the hook end is configured to constrain movement of the interstage seal along the radial direction and the axial direction, the integral protrusion is axially constrained in an upstream direction and a downstream direction by a groove adjacent a lower support of a second rotor wheel of the second turbine stage, and the lower body comprises a hollow region that is axially and radially enclosed relative to the rotational axis of the multi-stage turbine.

2. The system of claim 1, wherein the upstream seating arm is radially constrained by an upper support extending axially from a first bucket of the first turbine stage and the seating end is radially constrained by a second lower support extending axially from a first rotor wheel of the first turbine stage.

3. The system of claim 1, wherein the downstream seating arm is radially constrained by an upper support extending axially from a second bucket of the second turbine stage and the hook end is radially constrained by the lower support extending axially from the second rotor wheel of the second turbine stage.

4. The system of claim 1, wherein the upper body comprises a substantially linear sealing portion that extends from the upstream and downstream seating arms.

5. The system of claim 4, wherein the substantially linear sealing portion comprises a plurality of sealing teeth on a side of the sealing portion opposite the lower body.

6. The system of claim 1, wherein the interstage seal is entirely radially supported by rotor wheels of the first and second turbine stages.

* * * * *